United States Patent [19]

Delacruz

[11] 4,339,750

[45] Jul. 13, 1982

[54] LOW POWER TRANSMITTER

[75] Inventor: Moises A. Delacruz, Cottage Grove, Minn.

[73] Assignee: Rosemount Inc., Eden Prairie, Minn.

[21] Appl. No.: 179,711

[22] Filed: Aug. 20, 1980

[51] Int. Cl.[3] ..... G08C 19/10

[52] U.S. Cl. ..... 340/870.37; 340/870.39; 324/60 C; 324/60 CD

[58] Field of Search ..... 340/870.37, 870.3, 870.39; 324/60 R, 60 C, 60 CD

[56] References Cited

U.S. PATENT DOCUMENTS

| | | | |
|---|---|---|---|
| Re. 27,596 | 3/1973 | Hurd | 340/210 |
| 3,271,669 | 9/1966 | Lode | 324/60 |
| 3,318,153 | 5/1967 | Lode | 73/398 |
| 3,646,538 | 2/1972 | Frick | 340/870.37 |
| 3,775,687 | 11/1973 | Machlanski | 324/60 C |
| 3,854,039 | 12/1974 | Serrano | 235/193.5 |
| 3,859,594 | 1/1975 | Grindheim | 324/57 R |
| 3,975,719 | 8/1976 | Frick | 340/870.37 |
| 4,149,231 | 4/1979 | Bukosky et al. | 324/60 CD |
| 4,193,063 | 3/1980 | Hitt et al. | 340/870.39 |

OTHER PUBLICATIONS

E Output Schematic Drawing 1151-135, Rev. H., Rosemount Inc.

*Primary Examiner*—Gerald L. Brigance

*Attorney, Agent, or Firm*—Kinney, Lange, Braddock, Westman and Fairbairn

[57] ABSTRACT

A low power transmitter has a D.C. Power supply for providing the transmitter with power. The supply is coupled to a voltage regulator for regulating the voltage to the transmitter and the regulator is further coupled to an oscillator which provides a time varying voltage signal to a capacitance sensor which varies as a function of the parameter to be sensed. The charging and discharging current pulses from the sensor, as affected by such sensors, are rectified and fed to an oscillator driver amplifier which controls the time varying voltage as a function of such rectified signals. The rectified signals are also fed to a low power consumption output amplifier which provides a zero based D.C. voltage output signal representative of the parameter to be sensed along two wires. The transmitter operates on low voltage and has a low power consumption.

9 Claims, 2 Drawing Figures

LOW POWER TRANSMITTER

BACKGROUND OF THE INVENTION

1. Field of the Invention

This invention relates to a transmitter for sensing a parameter to be measured and for converting the sensed parameter to an electrical signal representative of such parameter and, more particularly, to a transmitter with the capability of operating from a low voltage power supply and using a relatively small amount of power.

2. Prior Art

Transmitters known in the art sense a parameter and produce an output electrical signal representative of such parameter. Drive voltage of such transmitters has been a concern in the design of such transmitters, as start-up circuitry is difficult at low lift off voltages, but power consumption below the line zero value, for example 4 MA in a 4–20 MA transmitter has not been a significant factor in the design thereof. Such transmitters are often the two wire current transmitter design, where a power supply and series connected load is coupled through two wires to two terminals of such transmitter. A D.C. current which typically is 4–20 MA (milliamperes) is then controlled by the transmitter. Typically 4 MA is consumed by the transmitter electronics.

SUMMARY OF THE INVENTION

This invention comprises a transmitter which is driven from a relatively low voltage power supply and which consumes a relatively low quantity of power as compared to known transmitters. Several advantages are derived from such operation, first there is considerable energy savings, in addition to the overall fiscal economies of such energy savings this invention enables a transmitter to be used with a relatively low voltage battery, and such battery may be recharged from a solar or photo voltaic cell using known components and design. Further, having such battery coupled proximate to the transmitter eliminates the requirement of hand wiring two wires from the supply and load to the transmitter, which may be a considerable distance of several miles, at considerable cost, as the signal representative of the parameter may be transmitted by radio signals, VHF, UHF, microwave, using AM, FM or other means using known sampling or polling techniques thus further eliminating the requirement of bringing power supply cables to the transmitter site. Further advantages of the invention are apparent from the disclosure and drawings.

DESCRIPTION OF THE PRFERRED EMBODIMENTS

Figure 1:
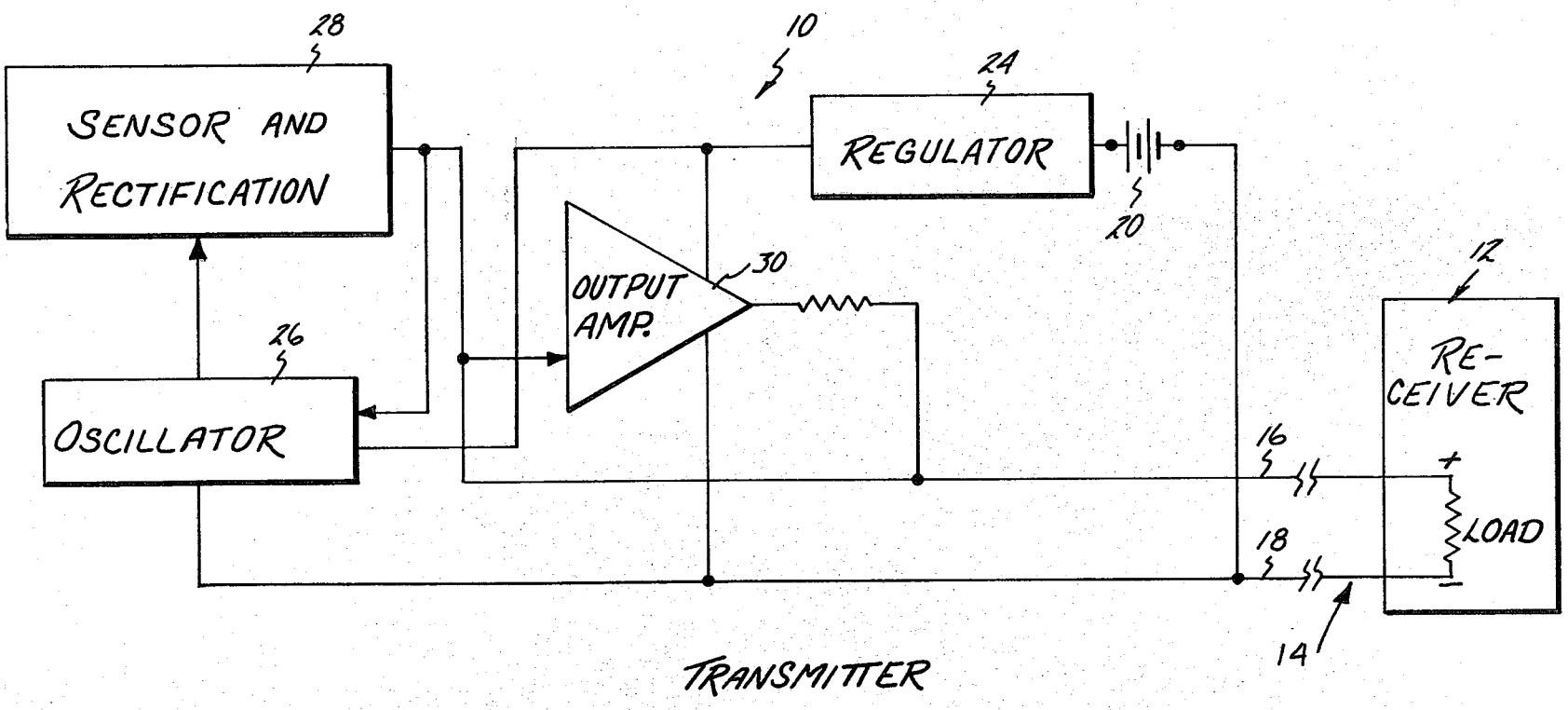
FIG. 1 is a block diagram of a low power transmitter made according to the present invention.

In FIG. 1, a transmitter according to the present invention is shown generally at 10 and a receiver is shown generally at 12. These two devices are shown coupled together by a transmission link 14 which preferably is two wires 16 and 18 which carry a D.C. voltage signal. The transmission link may also comprise a signal conversion-transmission means such as radio, telephone transmission link, microwave, etc. As shown in FIG. 1, an integral power supply 20, preferably a battery, and which may be a solar charged (photovoltaic cell) battery is shown at transmitter 10. Supply 20 may also be located at receiver 12 as shown in connection with FIG. 2 in which case a third wire is included in transmission link 14, and supply 20 at transmitter 10 is then eliminated. In either embodiment the power supply 20 feeds a regulator 24 which provides a regulated voltage for transmitter 10 circuitry. An oscillator 26 provides a time varying voltage to excite the sensing element(s) and rectifier circuit shown at 28 and, in turn the sensing element feeds back a signal through the rectifier circuit to oscillator 26 which controls the time varying output signal therefrom. The sensing element 28, through the rectifier, also provides a D.C. control signal to an output amplifier 30 which provides a zero based D.C. output signal along lines 16 and 18 to a load 32, which as shown in FIG. 1, is external from transmitter 10 and preferably is at receiver 12. The load may be proximate to transmitter 10 if desired.

Figure 2:
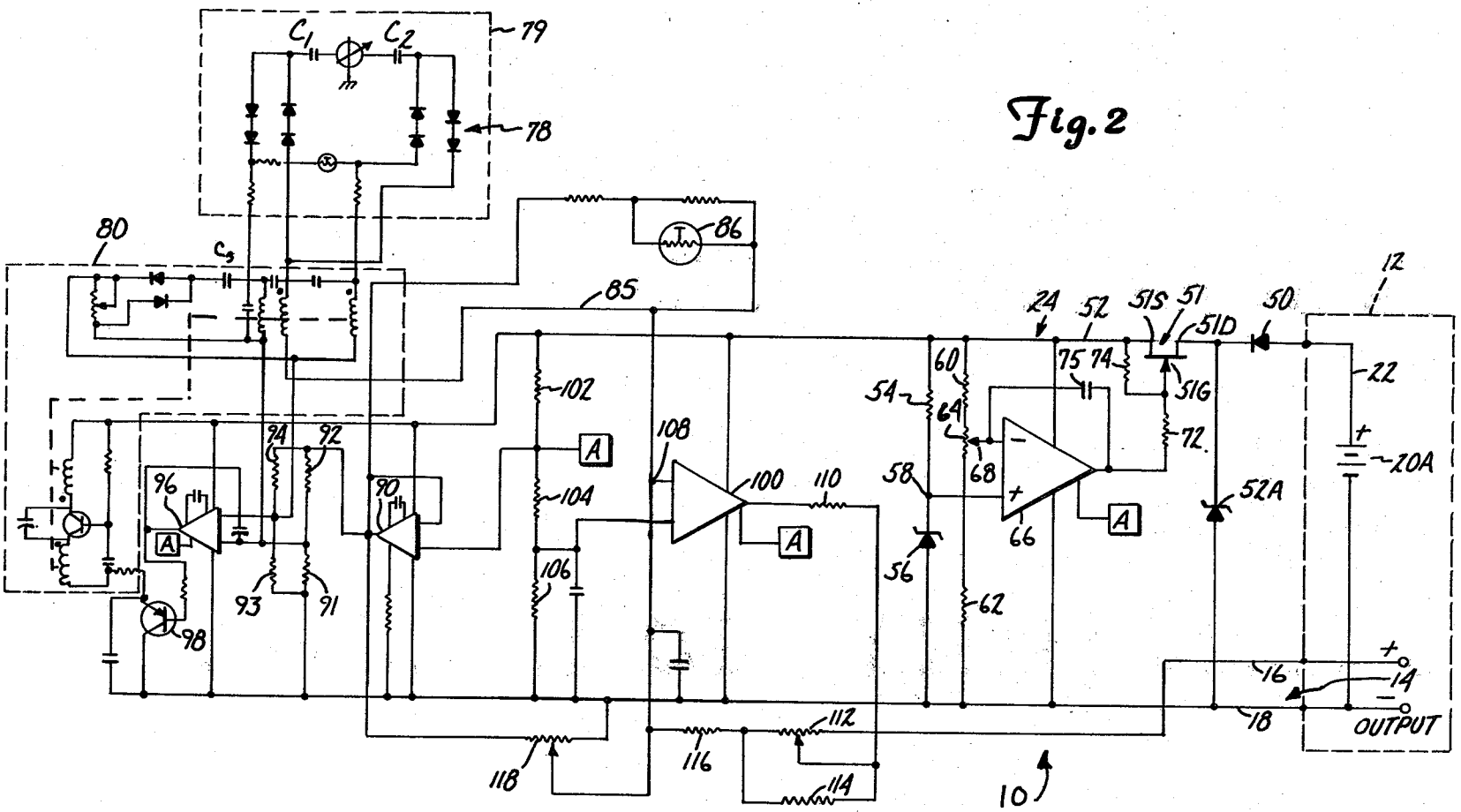
FIG. 2 is a detailed schematic representation of a modified form of the present invention.

A further preferred embodiment according to the present invention is shown in FIG. 2. In this embodiment, transmitter 10 according to FIG. 1 is shown with the detailed circuitry thereof. In this embodiment, power supply 20A is shown external to the transmitter 10, but it may also be integral thereto. Power supply 20A is connected to transmitter 10 by a line 22 to a reverse polarity protection diode 50. Diode 50 preferably is a low voltage drop, Schottky diode. A transient protection diode 52A is shown connected from line 22 to line 18. Regulator 24 is coupled to line 22 and line 18 by a pass element 51 which preferably is a field effect transistor having its drain 51D coupled to line 22 and its source 51S connected to line 52. Line 52 is coupled to line 18 through a series connected resistor 54, and voltage reference element 56, which preferably is a zener diode, or stabilized zener diode, thus establishing a reference voltage at a junction 58 of resistor 54 and diode 56. A voltage divider, comprising resistors 60 and 62 and a potentiometer 64, is coupled from line 52 to line 18. The wiper 68 of potentiometer 64 is coupled to one input of an error amplifier 66. This input provides a voltage signal representative of the voltage between lines 52 and 18. A second input to error amplifier 66 is connected to junction 58 and receives the reference voltage signal. Error amplifier 66, based on the signals at its inputs, outputs a signal along a line 70 through resistor 72 to control gate 51G of pass element 51. Resistor 74 protects pass element 51 from static discharge. A capacitor 75 connected from the output of error amplifier 66 to its inverting input provides compensation for regulator 24. Regulated power for error amplifier 66 is coupled thereto by lines 52 and 18.

In one preferred embodiment, error amplifier 66 is an Intersil Inc., 7611 low power operational amplifier programmed for operation at 100 μa (microamperes) by connection of error amplifier 66 to a circuit node A. In operation, pass element 51 permits current to flow when voltage is first applied to line 22, hence current flows through resistor 54 and diode 56 establishing the reference voltage at junction 58. Current also flows through the voltage divider 60 and, based on a comparison of the reference voltage at junction 58 and the voltage at wiper 68, error amplifier 66, responsive to such signals, outputs a signal to gate 51G so that pass element 51 continues to permit current to flow. As the voltage at wiper 68 approaches the reference voltage, the output signal from error amplifier 66 starts to turn off gate 51G to reduce the current in line 52 and thus regulate the voltage from line 52 to line 18.

The sensor and rectification circuitry 79 as disclosed is a grounded capacitive sensor, preferably a sensor having a diaphragm responsive to pressure positioned between two fixed plates thus forming two variable capacitors indicated as $C_1$ and $C_2$. The rectifier comprises a diode network 78 connected to $C_1$ and $C_2$ and the output windings of an oscillator 80. Operation of the oscillator 80 in connection with such a sensor and diode network is fully explained in U.S. Pat. No. 3,646,538 held by the same assignee as the present invention. In this embodiment, an amplifier 90 and resistors 91, 92, 93 and 94 are connected to provide a reference voltage and thus perform the function of zener diodes 46 and 49 and resistors 48 and 49 of FIG. 1 of U.S. Pat. No. 3,646,538. Further, the output of the oscillator control amplifier 96 of present FIG. 2 is provided to the base of a buffer transistor 98 which supplies current for the oscillator circuit under control of amplifier 96. In one embodiment, the reference output voltage of amplifier 90 is 1.6 volts to line 52 and 1.6 volts to line 18 which results in a reduction of the required sensor current for satisfactory operation. With the same values of $C_1$ and $C_2$ as the circuit of U.S. Pat. No. 3,646,538, the sensor current is reduced from approximately 160 μa in the circuit of U.S. Pat. No. 3,646,538 to 80 μa in the circuit of the instant invention. Such reduction considerably reduces the power consumption of the transmitter shown here. Oscillator 80 provides charging and discharging current for the sensor ($C_1$ and $C_2$) substantially in the manner explained in U.S. Pat. Nos. 3,271,669 and 3,318,153, which are also incorporated herein by reference. The oscillator output is controlled as a function of the relative values of capacitors $C_1$ and $C_2$ and the charging and discharging currents (or pulses) which pass through the rectification circuitry. The output signal from the sensor, which indicates a change in the parameter measured, is a D.C. signal provided on a line 85. Temperature compensation circuitry 86 is also included. The sensor output signal on line 85, representative of the parameter to be measured, is amplified by a low power consumption output amplifier 100 which has a first input coupled to receive a reference signal, which preferably is provided by a voltage divider between lines 52 and 18. As shown FIG. 2, resistors 102, 104 and 106 form such voltage divider and the first input of amplifier 100 is coupled between resistors 104 and 106. Circuit mode A is formed at the junction of resistors 102 and 104 and node A is coupled to error amplifier 66, amplifier 90 and low power consumption amplifier 100, to select the current consumption of such amplifier. A second input to amplifier 100 is from a current summing node 108, where D.C. filtered current, responsive to the change in capacitance of capacitors $C_1$ and $C_2$ ($i_{C2}-i_{C1}$) and a feedback current ($i_{fb}$) representative of the output of amplifier 100 is provided. The feedback current is provided through resistors 110, 112, 114 and 116, all connected to the output of amplifier 100. A current from the output signal from amplifier 90 is also provided at summing node 108 through a variable resistor 118, which preferably is adjusted to compensate for non-symmetry of the sensor. Responsive to the signals at its inputs, amplifier 100 provides an output voltage signal representative of the parameter to be measured. In a preferred embodiment, this signal is a zero based voltage signal along line 16 referenced to line 18.

Typically two wire current transmitters operate on a 4–20 MA (milliampere) current driven by 12 to 45 VDC (volts direct current), hence consuming 48 to 900 MW (milliwatts). The present transmitter operates from a power supply of less than 10 VDC, and in one embodiment 5 VDC nominal. By lowering the voltage to the oscillator and by eliminating two zener diode reference sources and by providing a single amplifier for such reference to thereby reduce the sensor current; by reducing the power consumption of the other amplifiers; by providing a voltage output to a high impedance load rather than a current output; and by providing an improved voltage regulation means 24, the transmitter of the present invention requires only 1.5 MA. Thus the power consumption is nominally 7.5 MW or minimally a six to one reuduction in power consumption over conventional transmitters. One benefit of such reduction is energy savings, but further, in the embodiment shown in FIG. 1 the reduction in power consumption significantly extends battery life and permits use of a battery to be recharged using known solar cells. Thus a local or remote zero based two wire output signal may be provided to readout or other equipment as desired.

A table of components for the elements of one preferred embodiment of FIG. 2 follows:

| | MODEL | MFGR. |
|---|---|---|
| Amplifiers 24, 96 and 100 | ICL 7611 | Intersil Inc. Cupertino, CA |
| Amplifier 90 | μa 776 | |
| Diode 50 | MBR020 | |
| Diode 52A | 1N 4743 | |
| Diode 56 | LM 385 | National Semiconductors |
| Transistor 51 | 2N5246 | |
| Transistor 98 | 2N2907 | |

What is claimed is:

1. A low power transmitter having power supply means for providing the transmitter with power, voltage regulator means coupled to the power supply means for regulating the voltage provided for the transmitter, oscillator means coupled to the regulator means for providing a time varying voltage as a function of the voltage of the regulator means, sensor means coupled to the oscillator means for receiving the time varying voltage therefrom and for excitation thereof, said sensor means being responsive to changes in a parameter to be sensed and affecting the time varying signal responsive to the change in the parameter, said sensor means further including rectifier means for rectifying the affected time varying signal to provide a D.C. signal as a function of the parameter to be measured, driver means coupled to the sensor means to drive the oscillator responsive to the D.C. signal, low power consumption amplifier means coupled to receive the D.C. signal and to provide a zero based D.C. voltage output signal representative of the parameter to be measured along two wires, said voltage regulator means further comprising voltage reference means for establlishing a stable reference voltage, error amplifier means coupled to the reference voltage means to provide an error signal as a function of the voltage from the reference voltage means and the voltage from the power supply means, and pass element means coupled to receive the error signal and coupled to the power supply to regulate transmitter voltage at a level not substantially greater than ten volts, the voltage regulator means, oscillator means, sensor means, driver means and low power consumption amplifier means providing such D.C. voltage output signal when the power supply means is limited to not substantially greater than ten volts.

2. Apparatus according to claim 1 wherein the voltage reference means is a zener diode.

3. Apparatus according to claim 2 wherein the error amplifier means comprises comparator means having first input means coupled to the reference voltage means, a voltage divider coupled across the output of the pass element means, second input means coupled to such voltage divider, and output means to provide an error signal as a function of the signals at the first and the second input means.

4. Apparatus according to claim 3 wherein the transmitter further comprises second voltage means coupled from the output of the pass element means to the driver means for providing a desired time varying voltage for the sensor means.

5. Apparatus according to claim 4 wherein the pass element means is a field effect transistor.

6. Apparatus according to claim 5 wherein the sensor means comprises at least a first capacitor plate means, and a diaphragm which forms a second plate, the first plate means and second plate forming at least one capacitor for measuring pressure.

7. Apparatus according to claim 6 wherein the power supply means is a battery and integral to the transmitter.

8. Apparatus according to claim 7 wherein the power supply means further comprises a solar cell.

9. Apparatus according to claim 6 wherein the power supply means is external from the transmitter and a third wire couples the power supply to the transmitter.

* * * * *